US005364139A

United States Patent [19]

Bergen et al.

[11] Patent Number: 5,364,139

[45] Date of Patent: Nov. 15, 1994

[54] DOOR LATCH ASSEMBLY

[75] Inventors: Gary R. Bergen, Yorba Linda; Thomas J. Ghostley, Anaheim, both of Calif.

[73] Assignee: Kwikset Corporation, Irvine, Calif.

[21] Appl. No.: 911,368

[22] Filed: Jul. 13, 1992

Related U.S. Application Data

[63] Continuation of Ser. No. 566,191, Aug. 10, 1990, abandoned.

[51] Int. Cl.[5] ..... E05C 1/16

[52] U.S. Cl. ..... 292/169; 292/336.3; 292/169.15; 292/358

[58] Field of Search ..... 292/169, 169.15, 358, 292/359, 336.3

[56] References Cited

U.S. PATENT DOCUMENTS

| | | | |
|---|---|---|---|
| 186,194 | 1/1877 | Barlow . | |
| 297,402 | 4/1884 | Howland . | |
| 936,185 | 10/1909 | Tanner . | |
| 939,191 | 11/1909 | Fletcher | 292/358 |
| 1,015,765 | 1/1912 | Spring . | |
| 1,396,441 | 11/1921 | Kulier | 292/169.21 |
| 2,002,542 | 5/1935 | McKinney, Jr. . | |
| 2,230,096 | 1/1940 | Voight . | |
| 2,344,484 | 3/1944 | Ledin et al. . | |
| 2,544,959 | 3/1951 | Hillgren | 292/169 |
| 2,676,051 | 4/1954 | Hillgren . | |
| 2,723,874 | 11/1955 | Hillgren . | |
| 2,727,773 | 12/1955 | Hagstrom | 292/358 |
| 2,998,273 | 8/1961 | Unetic | 292/169.15 |
| 3,582,121 | 6/1971 | Rollins . | |
| 4,143,529 | 3/1979 | Brummett et al. . | |
| 4,296,956 | 10/1981 | Colombo | 292/169 |
| 4,453,753 | 6/1984 | Fayerman et al. . | |
| 4,516,798 | 5/1985 | Bergen . | |
| 4,569,547 | 2/1986 | Fayerman et al. | 292/336.3 |
| 5,029,913 | 7/1991 | Wartian | 292/169 |

*Primary Examiner*—Peter M. Cuomo
*Assistant Examiner*—Darnell M. Boucher
*Attorney, Agent, or Firm*—Spencer T. Smith

[57] ABSTRACT

A door latch assembly (10) includes a latch bolt mechanism (60) having a bolt (62) movable between a door latching position and a door unlatching position. Assembly (10) further includes handle lever (16) and (36) at opposite ends of a square spindle 64. An adapter 68 is attached to spindle 64 and engages cam surfaces 158 and 160 of a slide 142 within mechanism (60) to facilitate movement of bolt 62 when either of the levers (16) or (36) are operated.

A locking plate 44 is attached to spindle 64 for movement therewith and is formed with a peripheral notch 138. A locking dog 48 is selectively positionable within notch 138 to prevent rotation of spindle 64 and movement of bolt 62 when an attempt is made to operate either of the levers 16 or 36.

A stop plate 230 is also mounted on spindle 64 for rotation therewith and is positioned to engage fixed stems 28 to preclude attempted movement of either of the levers 16 or 36 in an upward direction but permits downward movement thereof to facilitate movement of bolt 62.

5 Claims, 5 Drawing Sheets

DOOR LATCH ASSEMBLY

This is a continuation of application Ser. No. 07/566,191, filed Aug. 10, 1990 now abandoned.

BACKGROUND OF THE INVENTION

This invention relates to a door latch assembly and relates particularly to a spindle adapter which is mounted on a spindle for operating a latch bolt and further to a locking mechanism for selectively preventing operation of the latch bolt.

In a typical door-mounted latch arrangement, a spindle extends from within an outside latch operator, such as knobs, handles, levers and the like, through the door and into the inside latch operator. An intermediate portion of the spindle is located through a latch assembly which includes a door-latching bolt. Typically, the spindle conforms in cross section to the complementary shape of spindle-receiving openings in the latch operators and in the latch assembly In some instances, the spindle is formed with a square cross section. In other instances, the spindle is formed with a half-round or C-shaped cross section.

Due to the conformity of the cross section of the spindle to the spindle-receiving openings noted above, spindles of one cross section, for example a square cross section, cannot be used with latch operators and latch assemblies having half-round spindle-receiving openings. Therefore, the opportunity to use latch operators having square cross-section spindle openings with latch assemblies having half-round openings is precluded even though this may be desired from time to time in order to match the elements of two such systems into a viable product.

Frequently, door latch products are designed with facility for manually locking the latch assembly from inside the door on which the latch assembly is mounted. Such locking facilities could include a locking dog which is movable into the path of slide which is linked directly to the bolt of the latching assembly. An external pushbutton is coupled to the locking dog for selective positioning of the dog in the path of the slide. An assembly of this type is shown in U.S. Pat. No. 4,296,456 which issued on Oct. 27, 1981. A similar arrangement is illustrated in U.S. Pat. No. 4,142,529 which issued on Mar. 13, 1979.

Such locking dog arrangements require that the dog be located in the vicinity of the latch bolt whereby stress is exerted upon the bolt when an attempt is made to withdraw the bolt by attempted operation of the latch operator.

In view of the foregoing, there is an expressed need for a door latch mechanism which is adaptable to a square spindle drive and a half-round actuator for the latch bolt. Further there is a need for an externally controlled manual locking mechanism which will preclude operation of the latch bolt without directly introducing the locking mechanism into the vicinity of the latch bolt.

SUMMARY OF THE INVENTION

In view of the foregoing problems, it is an object of this invention to provide a door latch assembly having a latch bolt operator which is adaptable to permit a latch operator designed for one type of drive system to operate a latch bolt mechanism designed to operate from another type of drive system.

Another object of this invention is to provide a door latch assembly having a locking mechanism which is operable to prevent rotation of a drive spindle in an area removed from the associated bolt.

Still another object of this invention is to provide a door latch assembly having a locking mechanism wherein the latch operator is prevented from entering an oscillatory mode when it is released and returns to its home position.

With these and other objects in mind, this invention contemplates a door latch assembly which includes a latch bolt mechanism having a bolt contained therein and movable between an extended door latching position and a retracted door latching position. A first drive system in the mechanism is used to operably move the bolt between the two positions. A second drive system of different construction than the first drive system is coupled to a door operator for movement therewith. Adapter means are provided for coupling the first and second drive systems so that upon operation of the door operator a drive force is coupled through the second drive system and the adapter means to the first drive system to effect movement of the bolt.

The present invention further contemplates a door latch assembly which includes a latch bolt mechanism having a bolt movable between a latching position and an unlatching position. A drive system extends from outside of, to a position within, the mechanism. A door operator is coupled to the drive system at a location spaced from the mechanism. Selectively movable means are provided at a location between and outside of the door operator and the latch mechanism to selectively prevent movement of the driving means.

Additionally, the present invention contemplates a door latch assembly which includes a latch bolt mechanism containing a bolt movable between a latching position and an unlatching position. A door operator system is included and is normally operable in either of two directions to move the bolt. Means are interposed in the door operator system for preventing the system from being operable in a selected one of the two directions.

Other objects, features and advantages of the present invention will become more fully apparent from the following detailed description of the preferred embodiment, the appended claims and the accompanying drawings.

Figures 1, 4:
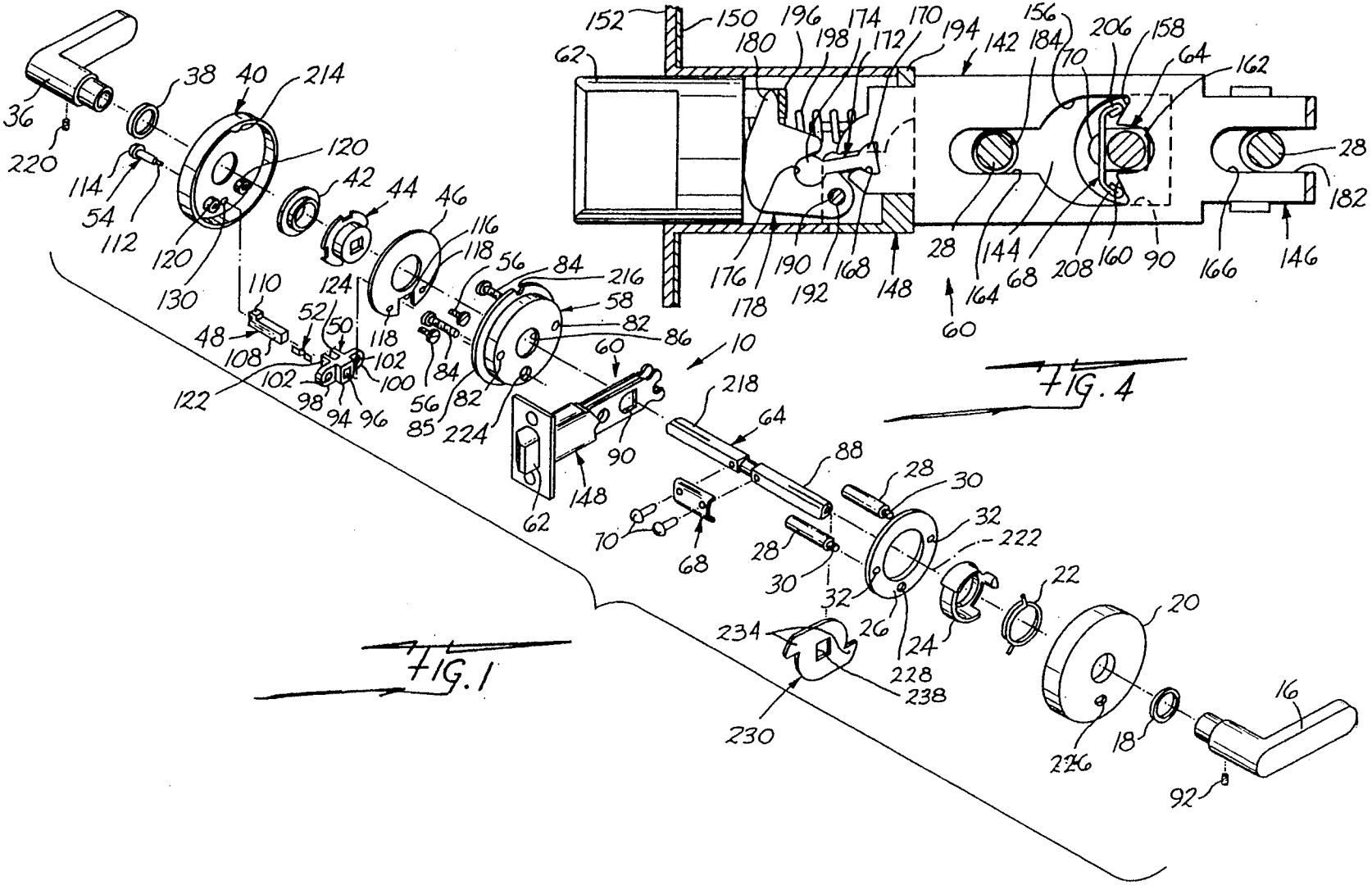
FIG. 1 is an exploded perspective view showing the elements of a door latch assembly in accordance with certain principles of the invention.
FIG. 4 is a side view of an assembly of the elements of FIG. 3 showing the manner of assembly in accordance with certain principles of the invention.
Figure 2:
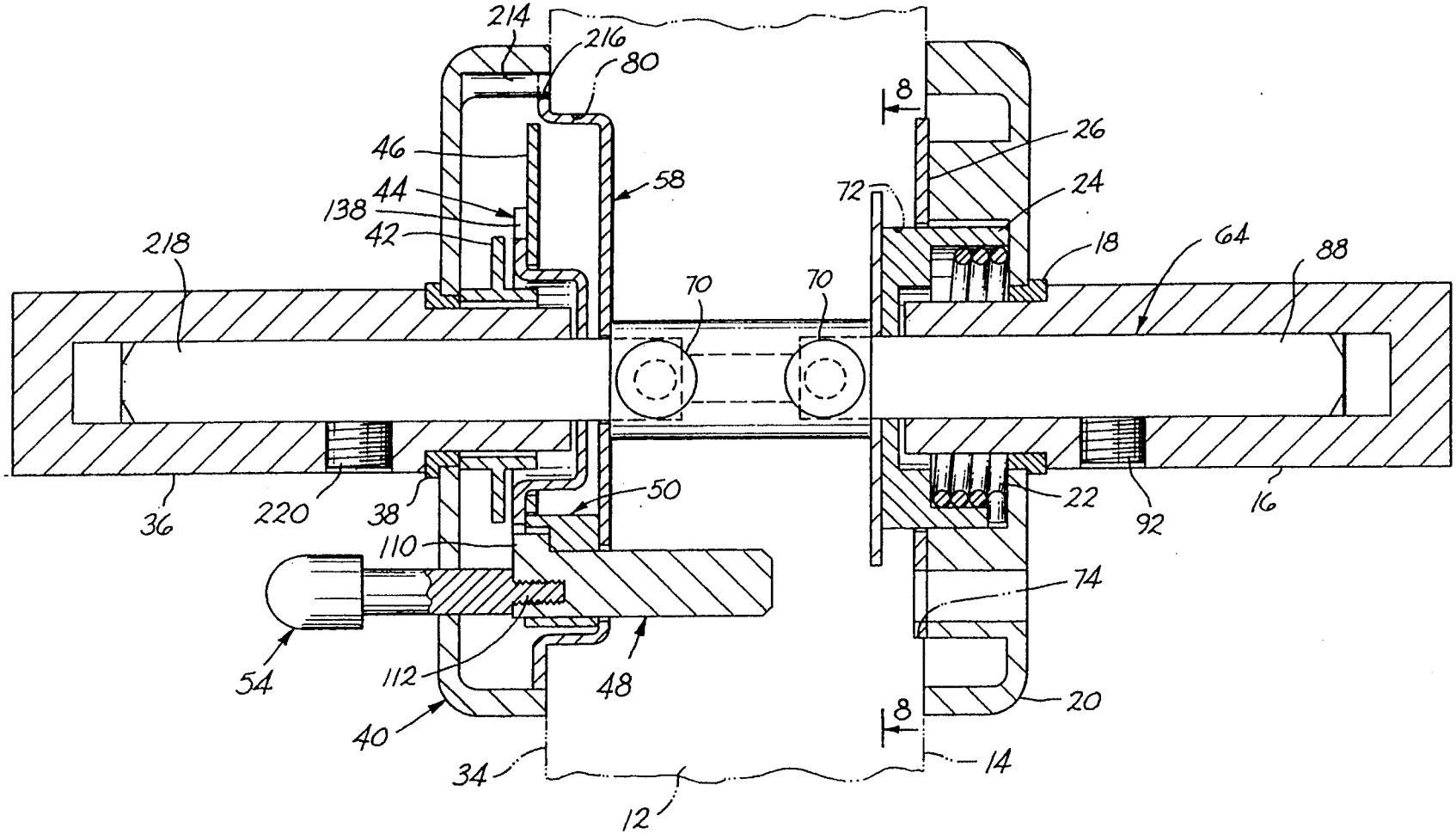
FIG. 2 is a side section view of the door latch assembly of FIG. 1 showing the elements in an assembled arrangement.
Figure 3:
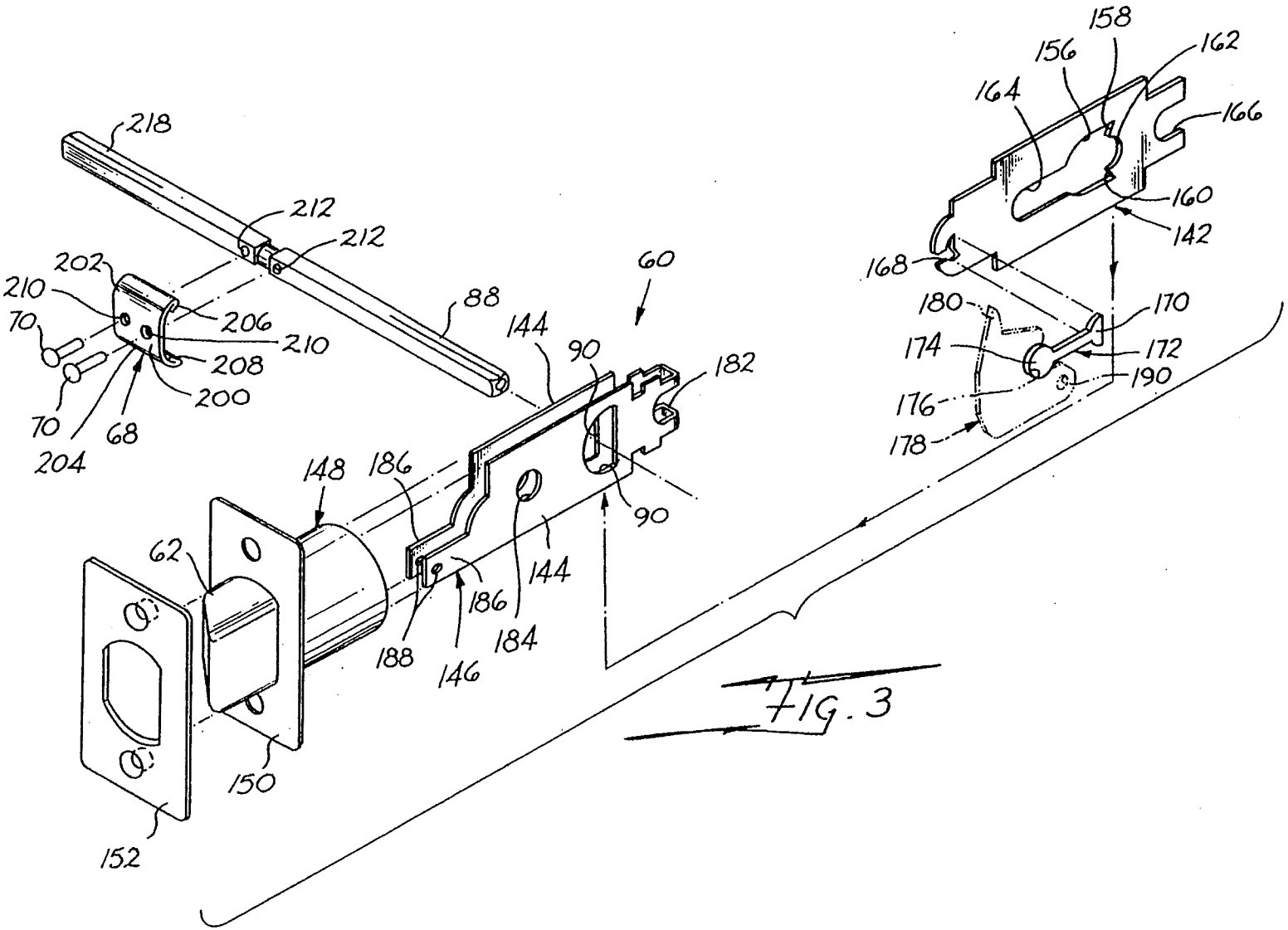
FIG. 3 is an exploded perspective view of a latch bolt assembly of FIG. 1 showing an arrangement of elements in accordance with certain principles of the invention.
Figure 7:
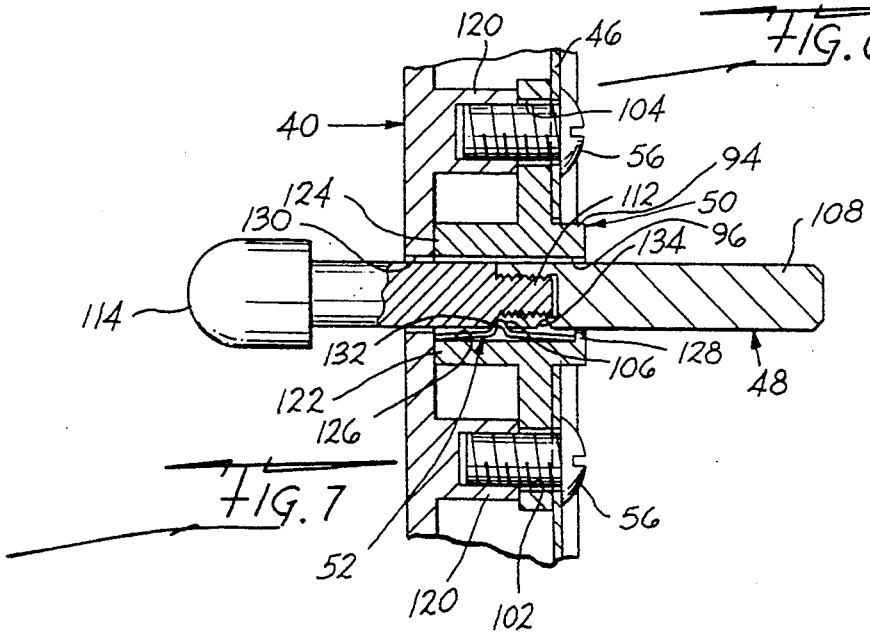
Figure 8:
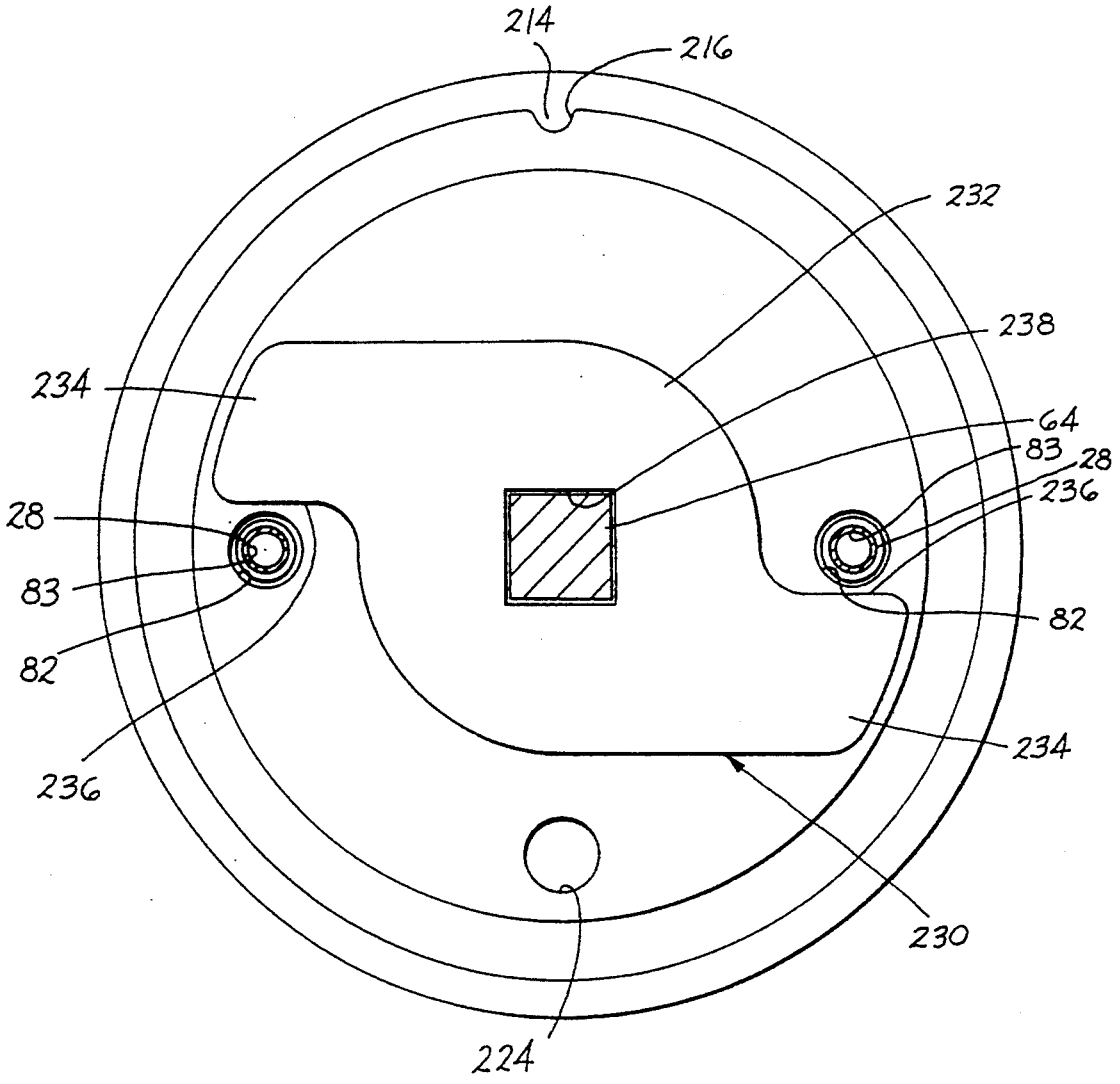

FIG. 7 is a cross-sectional plan view of the locking elements of FIGS. 3 and 4 taken along line 5—5 of FIG. 4 showing the manner of detenting a locking element in one of two positions in accordance with certain principles of the invention; and FIG. 8 is a sectional view taken along line 8—8 of FIG. 2 showing the location of a lever stop plate within the door latch assembly of FIG. 1 in accordance with certain principles of the invention.

DETAILED DESCRIPTION OF THE PREFERRED EMBODIMENTS

Referring to FIG. 1, there is illustrated the elements of a door latch assembly 10 for mounting on a door 12 which is shown in phantom in FIG. 2. As shown in FIG. 1, those elements which are mounted on and extend from an outside face 14 of door 12, and referred to as an exterior assembly, include a door operator or handle lever 16, a bearing 18, a rosette 20, a torque spring 22, a torque spring housing 24, a cover plate 26 and a pair of stems 28 having threaded ends 30. The outside elements are assembled in the alignment as shown in FIG. 1 with the threaded ends 30 being located through spaced apertures 32 in cover plate 26 and threadedly secured with threaded bosses (not shown) on the inside of rosette 20. Spring 22 and housing 24 are arranged within rosette 20 and cooperate with projections (not shown) which extend from the inside wall of the rosette to provide the spring-bias return of lever 16 after operation thereof in a conventional manner.

As further shown in FIG. 1, those elements which are mounted on an inside face 34 (FIG. 2) of door 12, and referred to as an interior assembly, include a door operator or handle lever 36, a bearing 38, a rosette 40, a flange 42, a locking plate 44 and a retainer plate 46. The interior assembly also includes a locking assembly formed by a locking dog 48, a locking housing 50, a detent spring 52, a push button 54 and a pair of screws 56.

The door latch assembly 10 also includes a mounting plate 58 and a latch bolt mechanism 60 which includes a latch bolt 62 movable between a forward extended latching position and a rearward retracted unlatching position in a conventional manner. A drive spindle 64 is formed with a square cross section formed to fit into square, complementary openings formed in levers 16 and 36, such as opening 66 formed in lever 36. An adapter 68 is attached to a central portion of spindle 64 and secured in place by rivets 70.

In assembly, the latch bolt mechanism 60 is located within a slot (not shown) formed in the edge of door 12 in position for assembly with spindle 64 and adapter 68. The exterior assembly is mounted on the outside face 14 of door 12 with an inward portion of torque spring housing 24 and cover plate 26 mounted in recesses 72 and 74 (FIG. 2) formed in the door. Stems 28 are located in a through hole (not shown) in door 12 and through a hole 76 and a half-round slot 78 formed in latch bolt mechanism 60 and extend through an opening (not shown) in the door toward the inside face thereof. Mounting plate 58 is mounted within a recess 80 (FIG. 2) formed in the inside face of door 12 and is formed with a pair of through holes 82 which align with the inside ends of stems 28. The inside ends of stems 28 are formed with threaded apertures 83 (FIG. 8). Thereafter, a pair of screws 84 are positioned through holes 82 and into the threaded ends 83 of stems 28 to secure the mounting plate 58 in the position shown in FIG. 2. Mounting plate 58 is formed with a flange 85 which has a diameter greater than recess 80. Therefore, flange 85 will locate on the inside face 34 of door 12 as shown in FIG. 2.

Spindle 64 is located through a central opening 86 in mounting plate 58 with an end 88 being inserted through an opening 90 in the latch bolt mechanism 60, cover plate 26, housing 24, spring 22, rosette 20, bearing 18 and into lever 16. A set screw 92 serves to secure end 88 of spindle 64 within lever 16. As spindle 64 is positioned within opening 90 of latch bolt mechanism 60, adapter 68 is located symmetrically within the opening.

Figure 6:
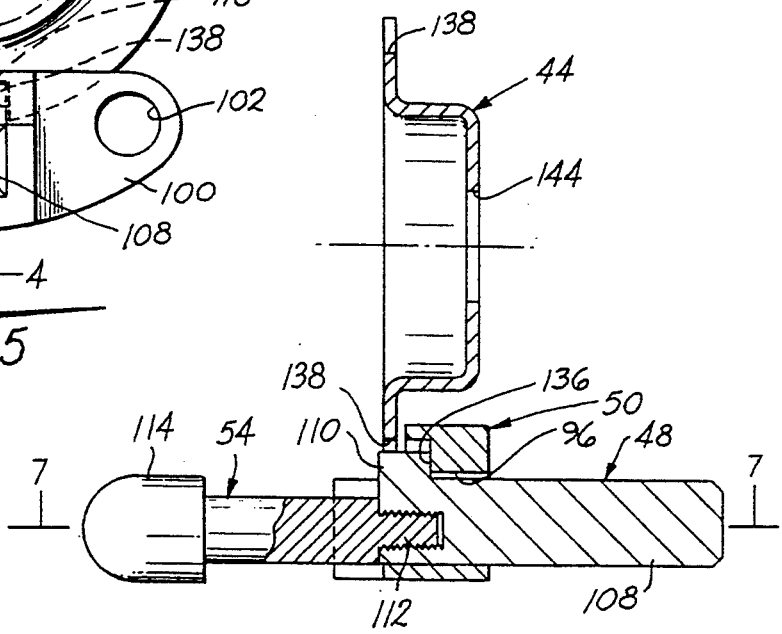
FIG. 6 is a cross-sectional side view of the locking elements of FIG. 3 taken along line 4—4 of FIG. 3 showing in detail the manner of locking some elements to preclude movement of the bolt in accordance with certain principles of the invention.

Housing 50 is formed with a central projection 94 which has a square hole 96 formed therethrough to receive locking dog 48 for sliding movement therein. Housing 50 is formed with a pair of wings 98 and 100 which extend on opposite sides of central projection 94. Through holes 102 and 104 are formed in wings 98 and 100, respectively. Spring 52 is formed centrally with a detent 106 (FIG. 7). Locking dog 48 is formed with a shank 108 which is located within opening 96 of housing 50 and an upstanding ear 110 as shown in FIG. 6. Pushbutton 54 is formed with a threaded end 112 at one end thereof and a head 114 at the other end. Projection 94 of housing 50 is located within a slot 116 of retainer plate 46 with wings 98 and 100 being located on the far side of the retainer plate. In this position, a pair of holes 102 of housing 50 are aligned with a pair of holes 118 formed in retainer plate 46 and a pair of threaded holes formed in a pair of bosses 120 extending from the interior wall of rosette 40.

As shown in FIG. 7, housing 50 is formed with a pair of spaced walls 122 and 124 which extend in a direction opposite from central projection 94. Spring 52 is positioned within a groove 126 formed on the inner surface of wall 122 and continues into opening 96 and terminates at a shoulder 128. As assembled, the outboard ends of walls 122 and 124 engage the inner wall of rosette 40 while wings 98 and 100 engage the outboard ends of bosses 120. With spring 52 located within groove 126, the ends of the spring are captured between shoulder 128 and the inner wall of rosette 40. The shank portion of pushbutton 54 is located within an opening 130 in rosette 40 and threaded end 112 is threadedly attached to one end of locking dog 48. Detent 106 of spring 52 is located to be positioned within either of two spaced detent notches 132 and 134 formed in one side of locking dog 48. Screws 56 are positioned through aligned openings 118 and 102 and are threaded into bosses 120 to secure the assembly.

As shown in FIG. 6, ear 110 of locking dog 48 engages a shoulder 136 to preclude movement of the locking dog further toward door 12. In the position illustrated in FIG. 6, a portion of ear 110 is located within a complementary slot 138 which is one of four equally spaced slots formed in the periphery of locking plate 44. A square hole 140 is formed centrally through locking plate 44.

Figure 5:
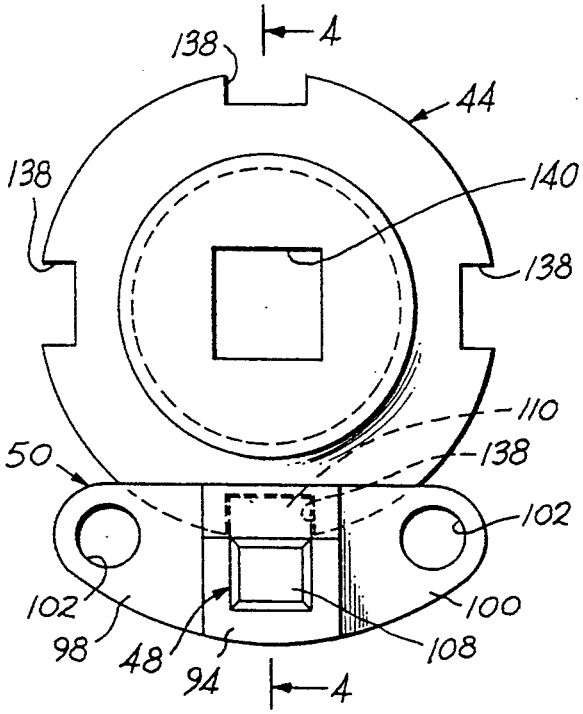
FIG. 5 is a front view of an assembly of some of the elements of FIG. 1 which assist in the facilitation of locking a bolt of the door latch assembly in accordance with certain principles of the invention.

The relationships of the various elements of FIGS. 6 and 7 are further illustrated in FIG. 5.

Referring to FIG. 3, the latch bolt mechanism 60 includes a slide 142 which is positioned between spaced sidewalls 144 of a case extension 146 for sliding movement therein. A latch case 148 houses an inward end of bolt 62 and also facility for moving the bolt. An inner face plate 150 is formed with latch case 148 and is assembled with a front plate 152 which is formed with a hole 154 configured to receive the outward end of bolt 62.

Slide 142 is formed with a central opening 156 which forms a pair of spaced cam surfaces 158 and 160 separated by an arcuate section 162. An elongated opening 164 extends from and communicates with opening 156. One end of slide 142 is formed with an open slot 166 having an arcuate base. The other end of slide 142 is formed with a "fishtail" slot 168 for receiving the "fishtail" end 170 of a link 172. It is noted that slot 168 is of sufficient size to permit limited pivot-like movement of link 172 relative to slide 142. The other end of link 172 is formed with a head 174 which is positioned in a complementary notch 176 formed in a cam 178. Cam 178 is formed with cam ear 180.

Case extension 146 is formed from a single sheet of metal material and is folded to provide the spaced sidewalls 144. The folded end of extension 146 is formed with an open slot 182 which is generally aligned with slot 166 when slide 142 is located between sidewalls 144. Opening 90 is formed through sidewalls 144 in a semicircular fashion and is generally alignable with the portion of opening 156 of slide 142 that includes cam surfaces 158 and 160. A pair of spaced openings 184 are formed in spaced sidewalls 144 and are alignable with a portion of elongated opening 164 of slide 142. The open ends 186 of case extension 146 extend into latch case 148 where the case extension is attached to the latch case. The ends 186 are formed with spaced openings 188. Cam 178 is formed with a hole 190. The portion of cam 178 which includes hole 190 is positioned between the spaced ends 186 of extension 146 and a pin 192 is positioned through aligned holes 188 and 190 to retain the cam with the extension but allow pivotal movement of the cam relative to the slide.

Referring to FIG. 4, the relationship between slide 142 and latch case 148 is illustrated. A reinforcing plate 194 is attached to the slide end of case 148. Case extension 146 is attached to latch case 148 (FIG. 3) in the vicinity of reinforcing plate 194 but is only visible in FIG. 4 at the end thereof which includes open slot 182. A cam follower extension 196 is attached to an inward portion of bolt 62 and is movable with the bolt. Ear 180 of cam 178 is positioned to engage a portion of extension 196 between the extension and bolt 62. When slide 142 is moved to the right as viewed in FIG. 4, cam 178 is pivoted about pin 192 to move ear 180 to the right whereby extension 196, and thereby bolt 62, are moved to the right against the biasing action of a spring 198.

Referring again to FIG. 3, adapter 68 is formed from sheet metal and has a straight intermediate section 200 and angled sections 202 and 204 which terminate in folded ends 206 and 208, respectively. A pair of holes 210 are formed in section 200 and are aligned with holes 212 formed in spindle 64. Rivets 70 are then utilized to secure adapter 68 with spindle 64. As noted above and as viewed in FIG. 4, spindle 64 is then positioned with openings 90 of extension 146 and opening 156 of slide 142 to position the folded ends 206 and 208 adjacent cam surfaces 158 and 160, respectively, of slide 142.

Referring again to FIG. 1, the subassembly formed by the assembled rosette 40, flange 42, locking plate 44, retainer plate 46 and the elements associated with locking dog 48 are located on spindle 64. In this assembly, square hole 140 (FIG. 5) of locking plate 44 is positioned on spindle 64 for rotary movement therewith. As rosette 40 is positioned over the periphery of flange 85 of mounting plate 58, a rib 214 formed on the upper inner side wall of the rosette is guided into a slot 216 formed in the flange so that the subassembly is aligned properly in relation to other elements of door latch assembly 10.

Bearing 38 and lever 36 are positioned on another end 218 of spindle 64 and a set screw 220 is threaded through a hole (not shown) in lever 36 to secure the lever in place which thereby holds the other elements against mounting plate 58.

In operation of door latch assembly 10, either of the levers 16 or 36 may be operated upwardly or downwardly to rotate spindle 64 in either direction about an axis 222 (FIG. 1) by virtue of the square-hole drive of the levers and the square cross-section of the spindle. As spindle 64 is rotated, adapter 68 is also moved about axis 222 whereby either folded end 206 or 208 engages and pushes against cam surface 158 or 160, respectively, of slide 142 as viewed in FIG. 4. In this manner, slide 142 is moved to the right, as viewed in FIG.4, thereby pulling link 172 and pivoting cam 178. As cam 178 is pivoted, ear 180 facilitates the movement of bolt 62 to a position within latch case 148 whereby door 12 is unlatched and can be opened.

Thus, a square cross-section drive system, such as that provided by spindle 64 and the complementary square openings of levers 16 and 36, is adapted to operate a latch bolt mechanism, such as mechanism 60, which is operated normally on a half-round drive system. The conversion from one drive system to the other permits the interchangeability of the elements of each system and avoids the need to redesign entire systems to accommodate differences in structure.

Referring now to FIGS. 1, 5, 6 and 7, the locking system provided by locking dog 48 is accomplished by selectively positioning ear 110 of the locking dog into slot 138 of locking plate 44. In this manner, when an attempt is made to rotate spindle 64 about axis 222 by operation of either lever 16 or 36, locking plate 44 is prevented from turning and thereby prevents spindle 64 from rotating. This action prevents operation of latch bolt mechanism 60 whereby door 12 remains latched.

Ear 110 is selectively positionable within slot 138 of locking plate 44 by axial movement of locking dog 48. This movement is accomplished by the gripping of head 114 and effecting sliding movement of locking dog 48 in the axial direction. To accommodate the movement, mounting plate 58 is formed with a hole 224 through which shank 108 moves. With this arrangement and location of the locking system which includes locking dog 48, the locking system is spaced from the latch bolt mechanism and places the locking stress on spindle 64 rather than on bolt 62.

It is also noted that rosette 20 and cover plate 26 are formed with aligned holes 226 and 228, respectively. Holes 226 and 228 are further aligned with hole 224 formed in mounting plate 58 through which shank 108 of locking dog 48 extends. In the event that it is necessary that door 12 be opened from outside of the door when locking dog 48 is in the locked position, an implement (not shown) can be passed through aligned openings 226 and 228 and into engagement with the end of shank 108. By further urging the implement toward locking dog 48, the locking dog is moved to the unlocked position and door 12 may now be opened.

Referring again to FIG. 1, in the preferred embodiment a stop plate 230 is formed with a central body 232 with a pair of offset wings 234 extending outwardly therefrom. Each of the wings 234 is formed with a stop surface 236 along the inner edge thereof. The central body 232 is formed with a square hole 238. Stop plate 230 is positioned so that spindle 64 is located through square hole 238 and the stop plate is located between cover plate 26 and latch bolt mechanism 60. In this position, stop surfaces 236 are resting on stems 28 as illustrated in FIG. 8.

Prior to the inclusion of stop plate 230 as illustrated in FIGS. 1 and 8, when either of the levers 16 or 36 was operated upwardly or downwardly, spindle 64 would rotate accordingly to operate latch bolt mechanism 60 and retract bolt 62 within latch case 148. When the lever 16 or 36 was released, torque spring 22 would facilitate the return of the lever to a normal rest or home position in a horizontal plane as illustrated in FIG. 1. However, the lever 16 or 36 would enter a mode of damping in the vicinity of the home position and would thereby oscillate briefly.

By inclusion of stop plate 230, levers 16 and 36 cannot be operated upwardly by virtue of the engagement of stop surfaces 236 with stems 28. When levers 16 and 36 are operated downwardly from the home position and then released, the levers return to the home position through the action of torque spring 22. However, levers 16 and 36 are prevented from entering a mode of damping by engagement of stop surfaces 236 with stems 28. This provides a smooth, non-vibrating return of levers 16 and 36 to the home position and eliminates the undesirable oscillations previously experienced.

In general, the above-described embodiment is not to be construed as limited the breadth of the present invention. Modifications, and other alternative constructions, will be apparent which are within the spirit and scope of the invention as defined in the appended claims.

What is claimed is:

1. A door latch assembly, which comprises:

a latch bolt mechanism;

a bolt contained with the latch bolt mechanism and movable between an extended door latching position and a retracted door unlatching position;

a drive system extending from outside the latch bolt mechanism to a location within the latch bolt mechanism to facilitate movement of the bolt between the latching position and the unlatching position;

a door operator coupled to the drive system at a location spaced from the latch bolt mechanism for facilitating operation of the drive system to move the bolt;

the drive system including a spindle having a spindle axis which extends between the door operator and the latch bolt mechanism for coupling the door operator to the latch bolt mechanism;

a locking plate mounted on the spindle at a location intermediate of and spaced from the door operator and the latch bolt mechanism for rotation with the spindle;

the locking plate formed with a slot in the periphery thereof so that the slot is located in a plane which includes the locking plate;

a locking dog mounted within the door latch assembly in a position for reciprocal movement along a dog axis which is parallel to and spaced from the spindle axis, and means for moving the locking dog into the peripheral slot of the locking plate at a location spaced from and independently of the latch bolt mechanism and the portion of the drive system associated therewith.

2. The door latch assembly as set forth in claim 1 which further comprises:

a rosette;

a locking dog housing for supporting the locking dog for sliding movement;

means for attaching the housing to an interior portion of the rosette;

pushbutton means located partially extending from an exterior portion of the rosette and attached to the locking dog to facilitate positioning of the locking dog within the housing and into the slot of the locking plate.

3. The door latch assembly as set forth in claim 2 which further comprises detent spring means for locating the locking dog in a locked position or an unlocked position whereby the locking dog is located in the slot or outside of the slot, respectively.

4. A door latch assembly, which comprises:

a latch bolt mechanism;

a bolt contained with the latch bolt mechanism and movable between an extended door latching position and a retracted door unlatching position;

a first drive system located in the latch bolt mechanism and including a slide attached to the bolt for movement therewith and formed with a cam surface for operably moving the bolt between the latching and unlatching positions;

a door operator for facilitating the operation of the door latch assembly by a user operator;

a square spindle drive system coupled to the door operator for movement therewith;

an adapter plate formed with a flat portion and at least one intermediate portion extending angularly therefrom with a free end of the intermediate portion being folded on itself to strengthen the free end, and the cam surface positioned for engagement with the end of the plate so that, upon operation of the door operator, the square spindle is rotated and the plate is moved therewith to urge the end into pushing engagement with the cam surface to move the slide and the bolt.

5. A door latch assembly, which comprises:

a latch bolt mechanism which contains a bolt movable between an extended door latching position and a retracted door unlatching position;

a door operator system including a spindle and a handle attached to the spindle for rotating the spindle normally in either of two directions to move the bolt from the latching position to the unlatching position;

a fixed element;

a stop plate having a central body;

at least one wing extending from the central body for engaging the fixed element;

a hole formed in the body and having a shape complementary to the cross section of the spindle for mounting the stop plate on the spindle for movement therewith, and the wing is positioned at a home or rest position to prevent the spindle and the handle from rotating in a selected one of the two directions.

* * * * *